US008783329B2

(12) United States Patent
Hsieh

(10) Patent No.: US 8,783,329 B2
(45) **Date of Patent: *Jul. 22, 2014**

(54) SUN SHADER APPARATUS

(76) Inventor: Paul Hsieh, City of Industry, CA (US)

( * ) Notice: Subject to any disclaimer, the term of this patent is extended or adjusted under 35 U.S.C. 154(b) by 68 days.

This patent is subject to a terminal disclaimer.

(21) Appl. No.: 13/373,025

(22) Filed: Nov. 1, 2011

(65) Prior Publication Data

US 2013/0105096 A1 May 2, 2013

(51) Int. Cl.
*E04F 10/00* (2006.01)

(52) U.S. Cl.
USPC ..... 160/45; 160/56; 160/83.1; 160/127; 135/90; 472/118; 297/184.15

(58) Field of Classification Search
USPC ..... 160/45, 56, 83.1, 128; 472/118; 297/184.15, 184.17; 135/96, 115; 482/35
See application file for complete search history.

(56) References Cited

U.S. PATENT DOCUMENTS 298,515 A * 5/1884 Sutphen ..... 5/128
382,648 A * 5/1888 Hussey ..... 5/128
425,540 A * 4/1890 Forbriger ..... 5/128
769,913 A * 9/1904 Noble ..... 5/128
774,272 A * 11/1904 Poles ..... 5/128
851,927 A * 4/1907 Fyfe ..... 5/128
1,011,789 A * 12/1911 Hoffman ..... 5/129
1,054,251 A * 2/1913 Stone ..... 5/128
1,201,305 A * 10/1916 Jones ..... 5/122
2,291,721 A * 8/1942 Hutaff, Jr. ..... 472/125
4,757,563 A * 7/1988 An ..... 5/121
4,898,198 A * 2/1990 Castlebury ..... 135/90
6,001,021 A * 12/1999 Battaglia ..... 472/118
6,383,085 B1 * 5/2002 Tseng ..... 472/118
6,802,328 B2 * 10/2004 Lin ..... 135/96
7,435,183 B2 * 10/2008 Tseng ..... 472/125
2013/0005493 A1 * 1/2013 Kim ..... 472/118
2013/0095937 A1 * 4/2013 Hsieh ..... 472/116
2013/0105096 A1 * 5/2013 Hsieh ..... 160/379
2013/0225304 A1 * 8/2013 Hsieh ..... 472/118

* cited by examiner

*Primary Examiner* — Blair M. Johnson
(74) *Attorney, Agent, or Firm* — Raymond Y. Chan; David and Raymond Patent Firm

(57) ABSTRACT

A sun shading apparatus includes a supporting frame, a shading frame and a shading fabric. The supporting frame includes first and second leg frames, and a supporting bar extended between the first and the second leg frames, while the second leg frame has third and fourth mounting slots. The shading frame includes first and second coupling joints each having a V-shaped cross section, first and second frame members, and a reinforcing frame, wherein the supporting bar is extended between the first and second coupling joints. The first and the second frame member are coupled with the first coupling joint and the second coupling joint respectively, while the reinforcing frame is extended between the first and second frame member and the supporting bar to form a support platform. The shading fabric is detachably mounted on the support platform for shading adverse weather condition.

20 Claims, 8 Drawing Sheets

SUN SHADER APPARATUS

BACKGROUND OF THE PRESENT INVENTION

1. Field of Invention

The present invention relates to a shading apparatus, and more particularly to a sun shading apparatus comprising a shading frame which can be detachably attached onto a supporting frame so as to facilitate easy and convenient assembling and disassembling of the shading frame.

2. Description of Related Arts

A conventional shading device, such as an outdoor canopy or a gazebo, usually comprises a supporting frame, a shading frame upwardly extended from the supporting frame, and a shading fabric mounted on the shading frame for shading sunlight in an area underneath the shading fabric. Conventionally, the shading frame is mounted on the supporting frame in such a manner that the shading frame cannot be conveniently detached from the supporting frame. Moreover, each conventional shading device, such as a particular outdoor canopy, is specifically designed such that the shading frame can only be used for a predetermined supporting frame which comes with the entire package. As such, when either the supporting frame or the shading frame is broken or partially damaged, the owner has no choice but to purchase a new set of the shading device, because separate parts are usually not available or not compatible with existing supporting frame or the shading frame.

Moreover, conventional shading device usually does not allow the owner to add on additional structures. For example, when a user wishes to add a swing onto the shading device, the owner has to purchase a new set of swing and assemble it according to corresponding instructions. In other words, the swing has nothing to do with the shading device.

Because of this problem and because of the popularity of domestic swings, many swings do not come with a compatible shading device. As a result, the people, such as children, playing on the swing are directly exposed to sunlight and this may inhibit their willingness to continue playing because the weather may be too hot.

SUMMARY OF THE PRESENT INVENTION

The invention is advantageous in that it provides a sun shading apparatus comprising a shading frame which can be detachably attached onto a supporting frame so as to facilitate easy and convenient assembling and disassembling of the shading frame.

Another advantage of the invention is to provide a sun shading apparatus in which a shading frame can be detachably attached onto a pre-existing supporting frame, which can also support other structures, such a swing.

Another advantage of the invention is to provide a sun shading apparatus which is capable of providing effective yet convenient shading to activities taken place underneath the shading frame.

Another advantage of the invention is to provide a sun shading apparatus which is easy to be assembled and disassembled so as to facilitate widespread application of the present invention.

Additional advantages and features of the invention will become apparent from the description which follows, and may be realized by means of the instrumentalities and combinations particular point out in the appended claims.

According to the present invention, the foregoing and other objects and advantages are attained by providing a sun shading apparatus, comprising:

a supporting frame which comprises a first and a second leg frame, and a supporting bar extended between the first and the second leg frames, wherein the first leg frame has a first and a second mounting slot, while the second leg frame has a third and a fourth mounting slot;

a shading frame, which comprises:

a first and a second coupling joints each having a V-shaped cross section detachably coupled with two ends of the supporting bar respectively;

a first and a second frame member, wherein the first frame member has two ends detachably coupled with the first and the third mounting slot of the first coupling joint and the second coupling joint respectively, while the second frame member has two ends detachably coupled with the second mounting slot and the fourth mounting slot of the first and the second coupling joint respectively; and a reinforcing frame extended between the first and second frame members and the supporting bar to form a support platform by the first and second frame member and the reinforcing frame; and a shading fabric detachably mounted on the support platform for shading adverse weather condition in an area underneath the shading fabric.

Still further objects and advantages will become apparent from a consideration of the ensuing description and drawings.

These and other objectives, features, and advantages of the present invention will become apparent from the following detailed description, the accompanying drawings, and the appended claims.

DETAILED DESCRIPTION OF THE PREFERRED EMBODIMENT

Figure 1:
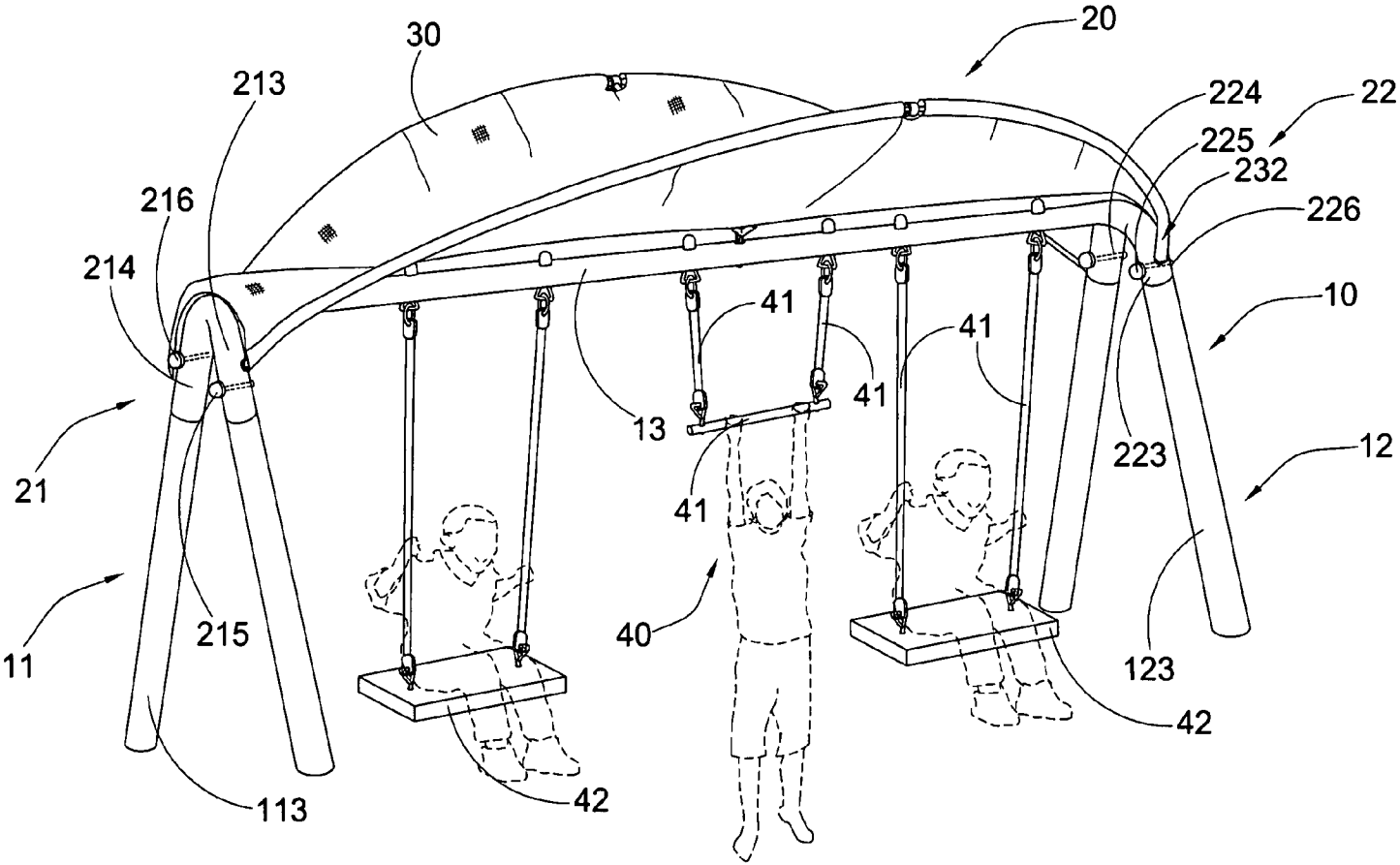
FIG. 1 is a perspective view of a sun shading apparatus according to a preferred embodiment of the present invention.

Referring to FIG. 1 to FIG. 2, FIG. 3A and FIG. 3B, and FIG. 4 of the drawings, a sun shading apparatus according to a preferred embodiment of the present invention is illustrated, in which the sun shading apparatus comprises a supporting frame 10, a shading frame 20, and a shading fabric 30.

The supporting frame 10 comprises a first and a second leg frame 11, 12 and a supporting bar 13 extended between the first and the second leg frame 11, 12, wherein the first leg frame 11 has a first and a second mounting slot 111, 112, while the second leg frame 12 has a third and a fourth mounting slot 121, 122.

The first and the second coupling joints 21, 22 each has a V-shaped cross section and is coupled with two ends of the supporting bar 13 respectively.

On the other hand, the shading frame 20 comprises a first and a second frame member 23, 24, wherein the first frame member 23 has two ends 231, 232 detachably coupled with the first and the third mounting slot 111, 121 of the first leg frame 11 and the second leg frame 12 respectively, while the second frame member 24 has two ends 241, 242 detachably coupled with the second mounting slot and the fourth mounting slot 112, 122 of the first and the second leg frame 11, 12 respectively.

The reinforcing frame 25 is extended between the first and second frame members 23, 24 and the supporting bar 13 to form a support platform by the first and second frame member 23, 24 and the reinforcing frame 25, wherein the shading fabric 30 is detachably mounted on the support platform for shading adverse weather condition in an area underneath the shading fabric 30.

According to the preferred embodiment of the present invention, the supporting frame 10 is for supporting the entire structure of the present invention, including any accessories or equipment attached onto the supporting bar 13. Thus, if the sun shading apparatus has a utility device 40 such as a swing detachably attached thereon, it would be supported by the supporting bar 12.

The first leg frame 11 comprises a plurality of first legs 113 inclinedly extended from the ground surface toward the supporting bar 13, wherein the first coupling joint 21 is mounted between the supporting bar 13 and the first legs 113. Moreover, the first and the second mounting slot 111, 112 are formed on the first coupling joint 21.

On the other hand, the second leg frame 12 comprises a plurality of second legs 123 inclinedly extended from the ground surface toward the supporting bar 13, wherein the second coupling joint 22 is mounted between the supporting bar 13 and the second legs 123. Moreover, the third and the fourth mounting slot 121, 122 are formed on the second coupling joint 22.

The first coupling joint 21 of the shading frame 20 preferably has a first joint body 213 and a second joint body 214 inclinedly extended from the corresponding end of the supporting bar 13 to form a V-shaped cross section, wherein the first coupling joint 21 further has a first and a second connecting slot 211, 212 formed on the first and the second joint body 213, 214 respectively. Similarly, the second coupling joint 22 of the shading frame 20 also has a third and a fourth joint body 223, 224 inclinedly extended from the corresponding end of the supporting bar 13 to also form a V-shaped cross section, wherein the second coupling joint 22 further has a third and a fourth connecting slot 221, 222 formed on the third and the fourth joint body 223, 224 respectively.

It is worth mentioning that each of the first through second joint body 213, 214, connect the first legs 113 with the corresponding end of the supporting bar 13 while the third through fourth joint body 223, 224 connect the second legs 123 to the corresponding end of the supporting bar 13 in this preferred embodiment. However, as a slight alternative, the V-shaped structure of the first and the second coupling joint 21, 22 can detachably ride on the two end portions of the supporting bar 12 respectively so as to connect the supporting bar 13 with the first and the second leg frames 11, 12.

Each of the first and the second frame member 23, 24 is elongated in shape and is made of strong yet slightly flexible materials (preferably bendable) for supporting the shading fabric 30. Moreover, each of the first and the second frame member 23, 24 is curved in shape so that when they are mounted on the first and the second leg frames 11, 12, they form a slightly concave structure for supporting the shading fabric 30 in a corresponding shape. In other words, the shading fabric 30 is supported in such a manner that it is arranged to form a concave structure for the sun shading apparatus.

The first frame member 23 further has a plurality of first connectors 233 formed at two ends 231, 232 thereof, wherein the first connectors 233 are arranged to detachably insert into the first mounting slot 111 and the third mounting slot 121 respectively so as to extend across the first leg frame 11 and the second leg frame 12 in a longitudinal direction of the sun shading apparatus. On the other hand, the second frame member 24 has a plurality of second connectors 243 formed at two ends 241, 242 thereof, wherein the second connectors 243 are arranged to detachably insert into the second mounting slot 112 and the fourth mounting slot 122 respectively so as to extend across the first leg frame 11 and the second leg frame 12 in a similar manner as that of the first frame member 23.

Figure 3A:
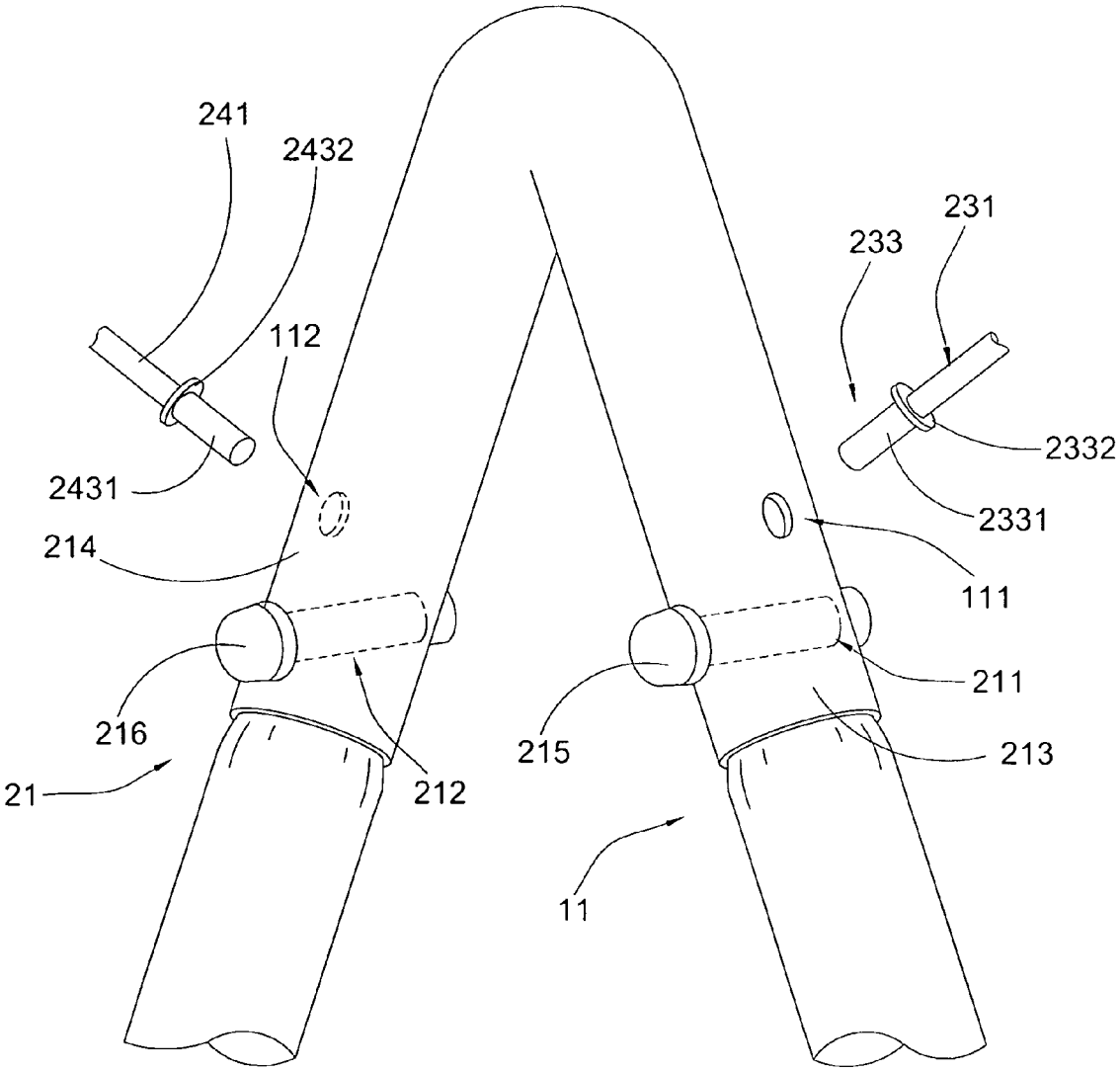
FIG. 3A and FIG. 3B are schematic diagrams of the first and the second connectors of the shading apparatus according to the above preferred embodiment of the present invention.
Figure 3B:
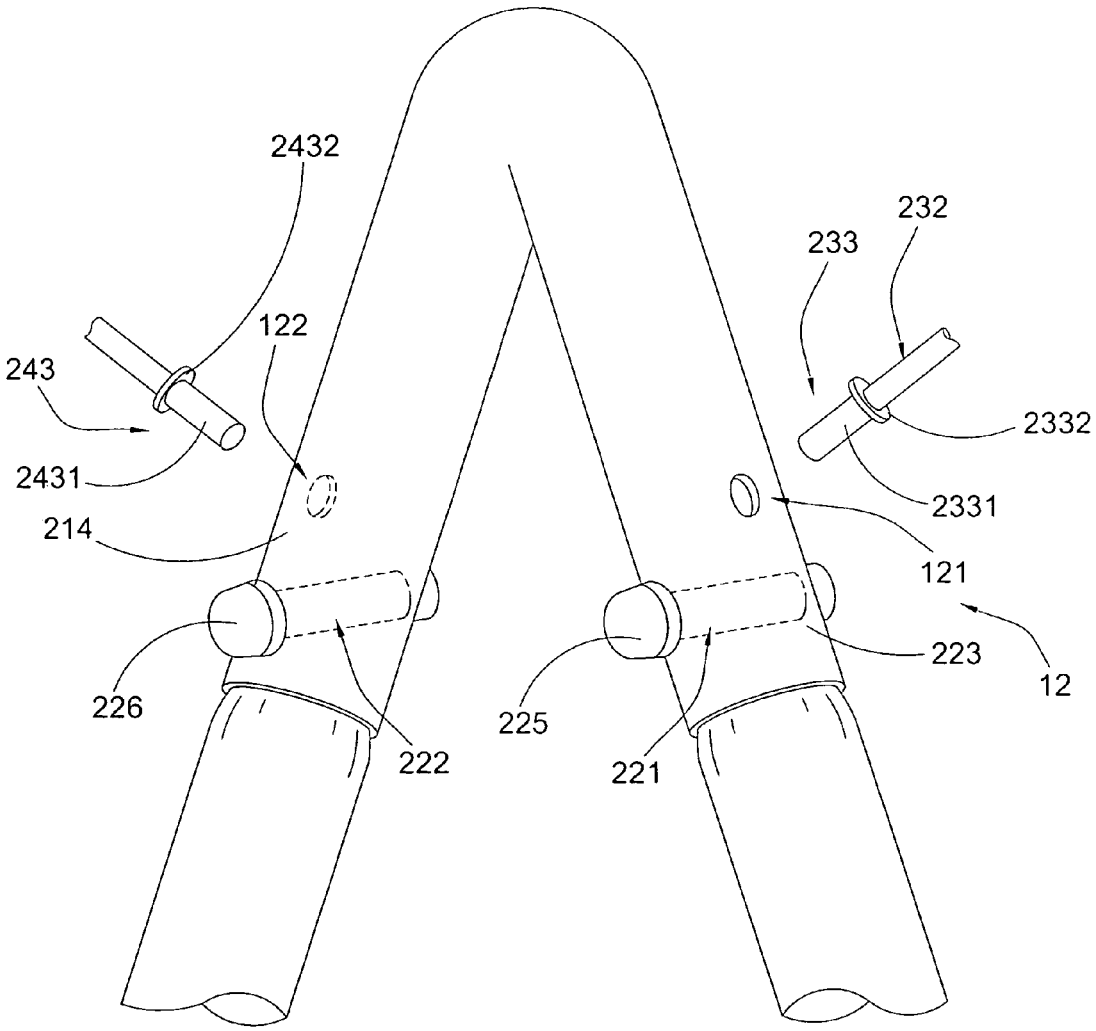
Figure 4:
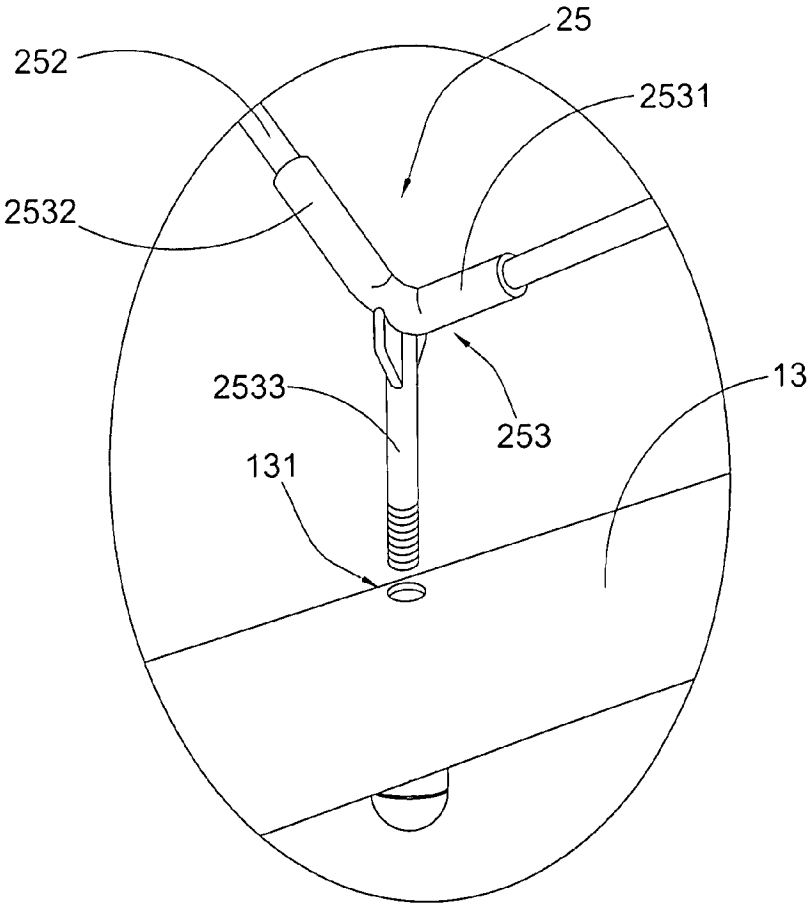
FIG. 4 is a schematic diagram of the reinforcing joint of the sun shading apparatus according to the above preferred embodiment of the present invention.

As shown in FIG. 3A of the drawings, each of the first connectors 233 has a first body portion 2331 arranged to be inserted into the corresponding mounting slot 111 (121), and a first stopper portion 2332 transversely and radially extended from the first body portion 2331 to stop a further inward movement of the first body portion 2331 of the first connectors 233. Similarly, as shown in FIG. 3B of the drawings, each of the second connectors 243 has a second body portion 2431 arranged to be inserted into the corresponding mounting slot 112 (122), and a second stopper portion 2332 transversely and radially extended from the second body portion 2431 to stop a further inward movement of the second body portion 2431 of the second connectors 243.

Furthermore, the first coupling joint 21 further comprises a first and a second coupler 215, 216 provided at the first and the second connecting slot 211, 212 respectively, wherein the first legs 113 are adapted to detachably mount to the first and the second joint body 213, 214 and selectively locked up by the first and the second coupler 215, 216 respectively.

Similarly, the second coupling joint 22 further comprises a third and a fourth coupler 225, 226 provided at the third and the fourth connecting slot 221, 222 respectively, wherein the second legs 123 are adapted to detachably mount to the third and the fourth joint body 223, 224 and selectively locked up by the third and the fourth coupler 225, 226 respectively.

The reinforcing frame 25 comprises a first and a second reinforcing member 251, 252 extended from the first frame member 23 and the second frame member 24 toward the supporting bar 13, and a reinforcing joint 253 provided at an intersection of the first reinforcing member 251, the second reinforcing member 252 and the supporting bar 13 so as to detachably connect the first reinforcing member 251, and the second reinforcing member 252 with the supporting bar 13.

It is worth mentioning that the first and the second reinforcing member 251, 252 may be two separate elements which are connected to the reinforcing joint 253. However, the first and the second reinforcing member 251, 252 may be integrally extended with each other for forming a V-shaped or U-shaped reinforcing frame 25. In any event, the reinforcing joint 253 is responsible for jointing the first and the second reinforcing member 251, 252 with the supporting bar 13.

Thus, the reinforcing joint 253 has first, second, and third joint members 2531, 2532, 2533 each having one end portion connected with the first reinforcing member 251, the second reinforcing member 252, and the supporting bar 13 respectively, and another end portion connected with each other. The supporting bar 13 further has a supporter slot 131 formed at a mid portion thereof, wherein the third joint member 2533 is arranged to insert into the supporter slot 131 and locked up by a securing connector 132 so as to mount the first and the second reinforcing member 251, 252 on the supporting bar 13 through the reinforcing joint 253.

The reinforcing frame 25 further comprises a first and a second fastening joint 254, 255 joining the first reinforcing member 251 with the first frame member 23, and joining the second reinforcing member 252 with the second frame member 24 respectively. More specifically, the first fastening joint 254 has a first tubular portion 2541 connected with the first frame member 23, and a first affixing portion 2542 extended from the first tubular portion 2541 and connected to the first reinforcing member 251. Similarly, the second fastening joint 255 has a second tubular portion 2551 connected with the second frame member 24, and a second affixing portion 2552 extended from the second tubular portion 2551 and connected to the second reinforcing member 252.

It is worth mentioning that the connection between the first fastening joint 254 with the first frame member 23 and the connection between the second fastening joint 255 and the second frame member 24 can be a slidable connection, a secure connection, and/or a detachable connection depending on the circumstances in which the present invention is manufactured or marketed.

Figure 2:
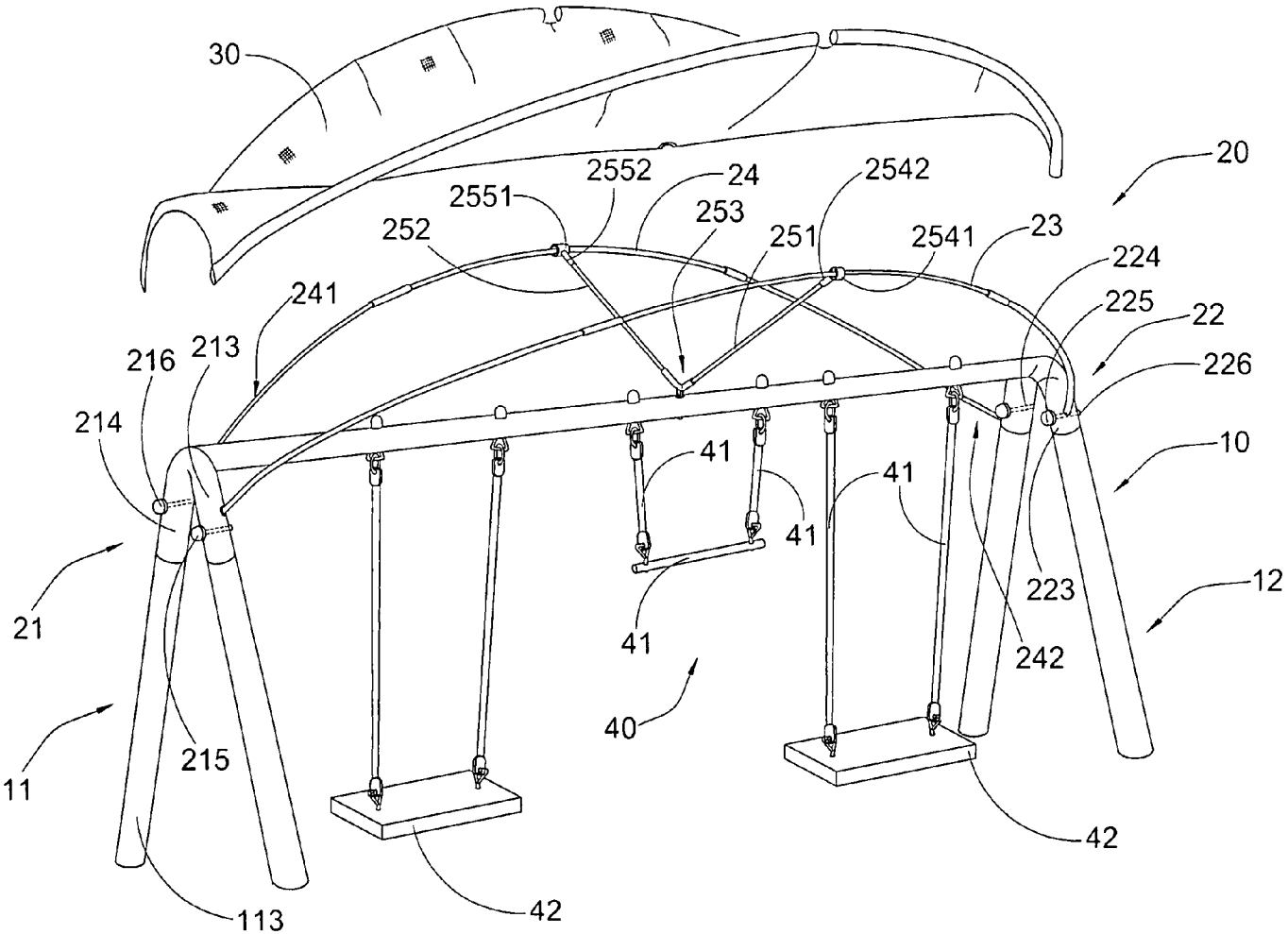
FIG. 2 is an exploded perspective view of the sun shading apparatus according to the above preferred embodiment of the present invention.

As shown in FIG. 1 and FIG. 2 of the drawings, the supporting frame 10 can be attached by a utility device 40 so that the utility device 40 is effectively shielded from sunlight. For example, when the utility device 40 is embodied as a swing, the utility device 40 may comprise a plurality of utility members 41 pivotally mounted on the supporting bar 13 and a seating member 42 extended across lower portions of the utility members 41 so that a person may seat on the seating member 42 and grab on the utility members 41 and perform swinging motions. The swing is fully and securely supported by the supporting frame 10, which is shielded by the sun shading frame 20 and the shading fabric 30. On the other hand, the utility device 40 may also be embodied as a training station in which the utility members 41 form training bars for the user to perform push-up exercise.

It is important to point out that the sun shading frame 20 is entirely detachably attached on the supporting frame 10 so that a user is able to conveniently assemble or disassemble the sun shading apparatus of the present invention. Moreover, the user is also able to detachably mount the sun shading frame 20 onto an existing supporting frame 10. This can be accomplished by mounting the first and the second coupling joint 21, 22 onto an existing supporting bar 13.

Figure 5:
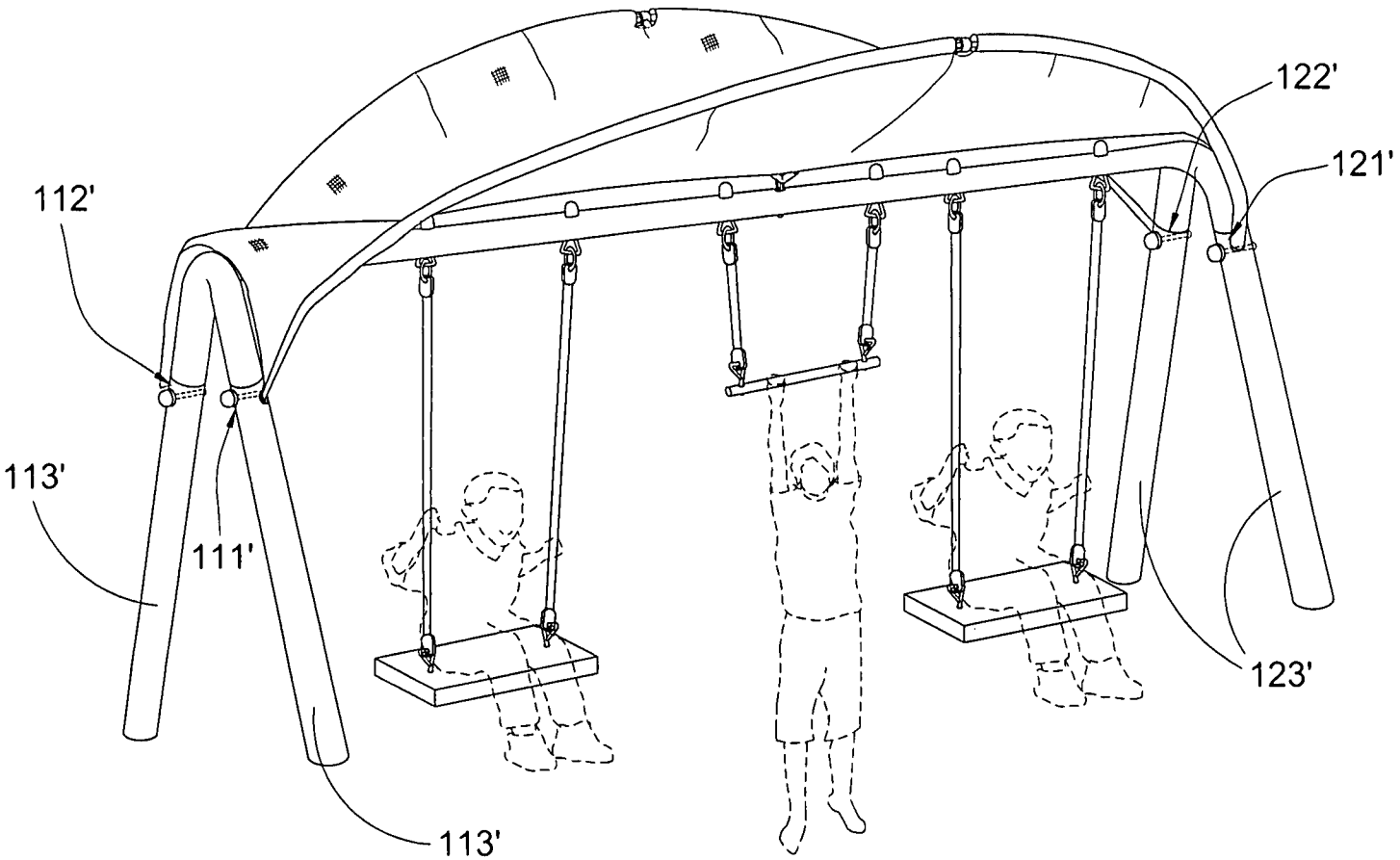
FIG. 5 is a first alternative mode of the sun shading apparatus according to the above preferred embodiment of the present invention.

Referring to FIG. 5 of the drawings, a first alternative mode of the sun shading apparatus according to the preferred embodiment of the present invention is illustrated. The alternative mode is similar to the preferred embodiment except the positions of the first through fourth mounting slot 111', 112', 121', 122'. In the alternative mode, the first through second mounting slot 111', 112' are formed on the first legs 113' while the third through fourth mounting slot 121', 122' are formed on the second legs 123'. Thus, the first and the second frame member 23', 24' are arranged to connect to the first legs 113' and the second legs 123' through the first through fourth connecting slot 111', 112', 121', 122'.

Figure 6A:
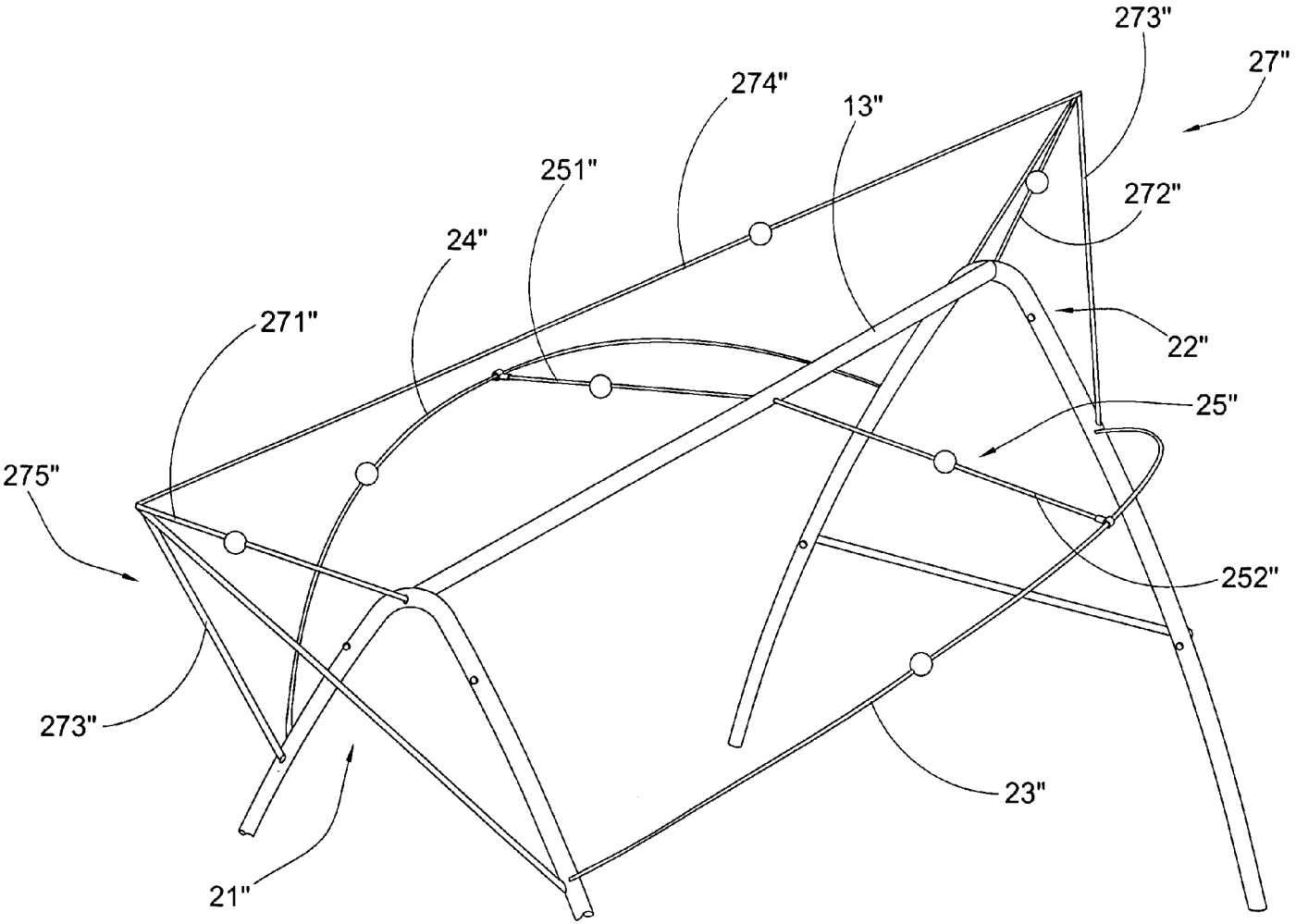
FIG. 6A and FIG. 6B are schematic diagrams of a second alternative mode of the sun shading apparatus according to the above preferred embodiment of the present invention.
Figure 6B:
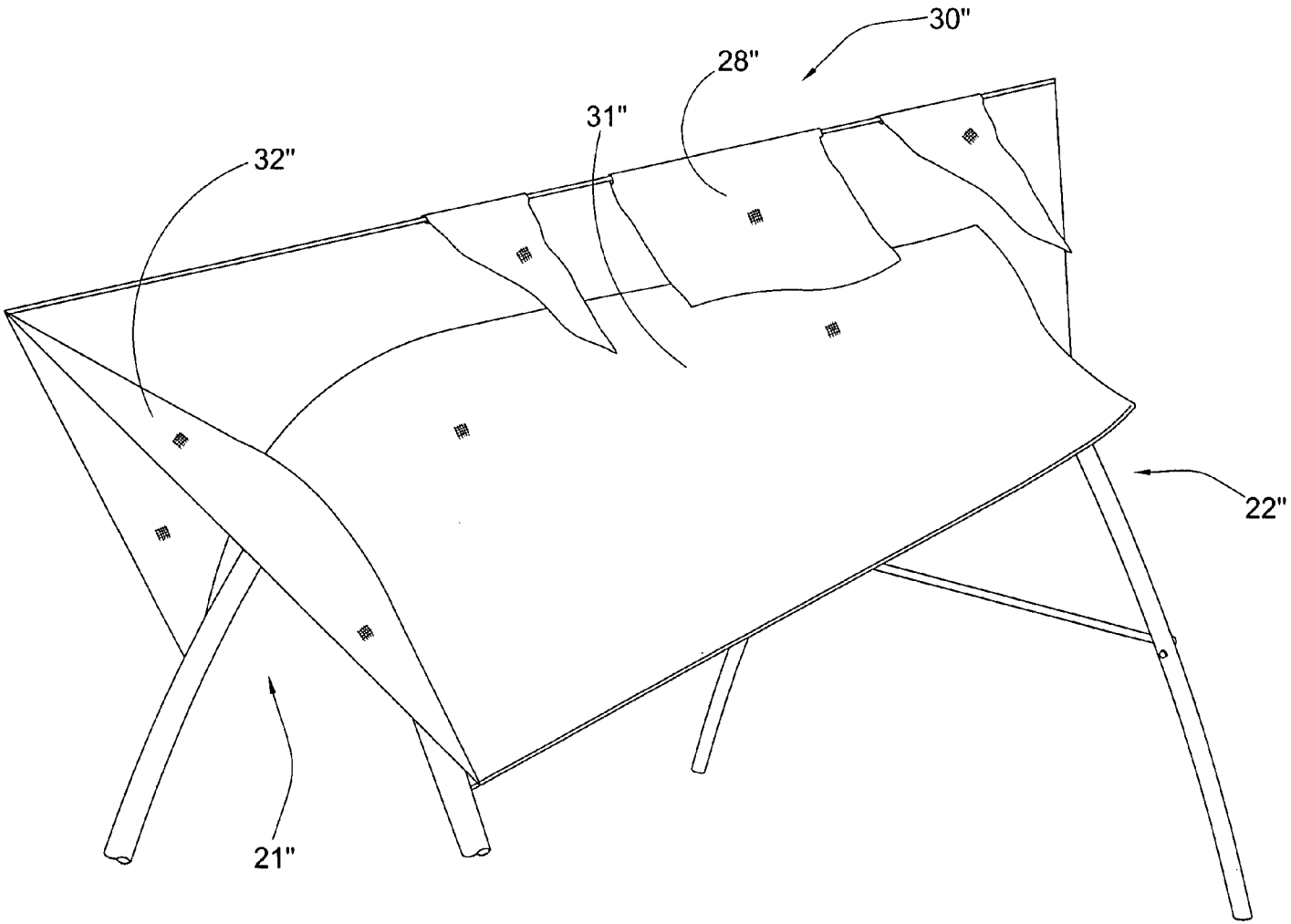

Referring to FIG. 6A to FIG. 6B of the drawings, a second alternative mode of the sun shading apparatus according to the preferred embodiment of the present invention is illustrated. The second alternative mode is similar to the preferred embodiment except the positions of the reinforcing frame 25", and that the shading frame 20" further comprises an auxiliary frame 27" provided on top of the supporting frame 10. According to the second alternative mode, the reinforcing frame 25" comprises a first and a second reinforcing member 251", 252" extended from the first frame member 23" and the second frame member 24" toward the supporting bar 13", wherein the first and the second frame member 23", 24" are sidewardly extended from the supporting frame 10 so as to form the corresponding support platform.

Furthermore, the auxiliary frame 27" comprises a first and a second auxiliary frame member 271", 272" upwardly extended from the first and the second coupling joint 21", 22" respectively, and a plurality of supporting members 273" extended between top ends of the first and the second auxiliary frame member 271", 272" and the corresponding coupling joints 21", 22" respectively for forming an auxiliary support platform 275". In addition, the auxiliary frame 27" further comprises a ceiling frame member 274" extended between the top ends of the first and the second auxiliary frame member 271", 272" for supporting predetermined accessories, such as flags 28".

Accordingly, the shading fabric 30" according to this second alternative mode comprises a main fabric 31" provided on the support platform and two auxiliary fabrics 32" provided on the auxiliary support platform 275" at two sides of the main fabric 31" respectively.

One skilled in the art will understand that the embodiment of the present invention as shown in the drawings and described above is exemplary only and not intended to be limiting.

It will thus be seen that the objects of the present invention have been fully and effectively accomplished. It embodiments have been shown and described for the purposes of illustrating the functional and structural principles of the present invention and is subject to change without departure from such principles. Therefore, this invention includes all modifications encompassed within the spirit and scope of the following claims.

What is claimed is:

1. A sun shading apparatus, comprising:

a supporting frame which comprises: a first and a second leg frame, and a supporting bar extended between said first and said second leg frames, wherein said supporting frame further has a first mounting slot, a second mounting slot, a third mounting slot, and a fourth mounting slot, a first and a second coupling joints each having a V-shaped cross section, wherein said supporting bar is extended between said first and second coupling joints, wherein said first and second mounting slots are formed at said first coupling joint, wherein said third and fourth mounting slots are formed at said second coupling joint;

a shading frame, which comprises:

a first and a second frame member, wherein said first frame member has two ends detachably coupled with said first and said third mounting slot of said first coupling joint and said second coupling joint respectively, while said second frame member has two ends detachably coupled with said second mounting slot and said fourth mounting slot of said first and said second coupling joint respectively; and a reinforcing frame extended between said first and second frame members and said supporting bar to form a support platform by said first and second frame member and said reinforcing frame; and a shading fabric detachably mounted on said support platform for shading adverse weather condition in an area underneath said shading fabric.

2. The sun shading apparatus, as recited in claim 1, wherein said first coupling joint of said shading frame has a first joint body and a second joint body inclinedly extended from said corresponding end of said supporting bar to form a V-shaped cross section, wherein said first and second joint bodies connect with said first leg frame.

3. The sun shading apparatus, as recited in claim 2, wherein said second coupling joint of said shading frame has a third and a fourth joint body inclinedly extended from said corresponding end of said supporting bar to also form a V-shaped cross section, wherein said third and fourth joint bodies connect with said second leg frame.

4. The sun shading apparatus, as recited in claim 3, wherein each of said first and said second frame member is elongated in shape and is made of strong yet slightly flexible materials for supporting said shading fabric, wherein each of said first and said second frame member is curved in shape so that when said first and said second member are mounted on said first and said second leg frame, said support platform forms a slightly concave structure for supporting said shading fabric in a corresponding shape.

5. The sun shading apparatus, as recited in claim 4, wherein said first frame member further has a plurality of first connectors formed at two ends thereof, wherein said first connectors are arranged to detachably insert_into said first mounting slot and said third mounting slot respectively so as to extend across said first leg frame and said second leg frame in a longitudinal direction of said sun shading apparatus.

6. The sun shading apparatus, as recited in claim 5, wherein said second frame member has a plurality of second connectors formed at two ends thereof, wherein said second connectors are arranged to detachably insert into said second mounting slot and said fourth mounting slot respectively so as to extend across said first leg frame and said second leg frame in a longitudinal direction of said sun shading apparatus.

7. The sun shading apparatus, as recited in claim 6, wherein said first leg frame comprises a plurality of first legs inclinedly extended from a ground surface toward said supporting bar, wherein said first coupling joint is mounted between said supporting bar and said first legs, wherein said first and said second mounting slot are formed on said first legs respectively.

8. The sun shading apparatus, as recited in claim 7, wherein said second leg frame comprises a plurality of second legs inclinedly extended from said ground surface toward said supporting bar, wherein said second coupling joint is mounted between said supporting bar and said second legs, wherein said third and said fourth mounting slot are formed on said second legs respectively.

9. The sun shading apparatus, as recited in claim 7, wherein said first coupling joint further has a first and a second connecting slot formed on said first and said second joint body respectively, wherein said first coupling joint further comprises a first and a second coupler provided at said first and said second connecting slot respectively, wherein said first legs are adapted to detachably mount to said first and said second joint body and selectively locked up by said first and said second coupler respectively.

10. The sun shading apparatus, as recited in claim 8, wherein said second coupling joint further has a third and a fourth connecting slot formed on said third and said fourth joint body respectively, wherein said second coupling joint further comprises a third and a fourth coupler provided at said third and said fourth connecting slot respectively, wherein said second legs are adapted to detachably mount to said third and said fourth joint body and selectively locked up by said third and said fourth coupler respectively.

11. The sun shading apparatus, as recited in claim 6, wherein said reinforcing frame comprises a first and a second reinforcing member extended from said first frame member and said second frame member toward said supporting bar, and a reinforcing joint provided at an intersection of said first reinforcing member, said second reinforcing member and said supporting bar so as to detachably connect said first reinforcing member and said second reinforcing member with said supporting bar.

12. The sun shading apparatus, as recited in claim 8, wherein said reinforcing frame comprises a first and a second reinforcing member extended from said first frame member and said second frame member toward said supporting bar, and a reinforcing joint provided at an intersection of said first reinforcing member, said second reinforcing member and said supporting bar so as to detachably connect said first reinforcing member and said second reinforcing member with said supporting bar.

13. The sun shading apparatus, as recited in claim 10, wherein said reinforcing frame comprises a first and a second reinforcing member extended from said first frame member and said second frame member toward said supporting bar, and a reinforcing joint provided at an intersection of said first reinforcing member, said second reinforcing member and said supporting bar so as to detachably connect said first reinforcing member and said second reinforcing member with said supporting bar.

14. The sun shading apparatus, as recited in claim 11, wherein said reinforcing joint has first, second, and third joint members each having one end portion connected with said first reinforcing member, said second reinforcing member, and said supporting bar respectively, and another end portion connected with each other, wherein said supporting bar further has a supporter slot formed at a mid portion thereof, wherein said third joint member is arranged to insert into said supporter slot and is locked up so as to mount said first and said second reinforcing member on said supporting bar through said reinforcing joint.

15. The sun shading apparatus, as recited in claim 12, wherein said reinforcing joint has first, second, and third joint members each having one end portion connected with said first reinforcing member, said second reinforcing member, and said supporting bar respectively, and another end portion connected with each other, wherein said supporting bar further has a supporter slot formed at a mid portion thereof, wherein said third joint member is arranged to insert into said supporter slot and is locked up so as to mount said first and said second reinforcing member on said supporting bar through said reinforcing joint.

16. The sun shading apparatus, as recited in claim 13, wherein said reinforcing joint has first, second, and third joint members each having one end portion connected with said first reinforcing member, said second reinforcing member, and said supporting bar respectively, and another end portion connected with each other, wherein said supporting bar further has a supporter slot formed at a mid portion thereof, wherein said third joint member is arranged to insert into said supporter slot and is locked up so as to mount said first and said second reinforcing member on said supporting bar through said reinforcing joint.

17. The sun shading apparatus, as recited in claim 14, wherein said reinforcing frame further comprises a first and a second fastening joint joining said first reinforcing member with said first frame member, and joining said second reinforcing member with said second frame member respectively, wherein said first fastening joint has a first tubular portion connected with said first frame member, and a first affixing portion extended from said first tubular portion and connected to said first reinforcing member, wherein said second fastening joint has a second tubular portion connected with said second frame member, and a second affixing portion extended from said second tubular portion and connected to said second reinforcing member.

18. The sun shading apparatus, as recited in claim 15, wherein said reinforcing frame further comprises a first and a second fastening joint joining said first reinforcing member with said first frame member, and joining said second reinforcing member with said second frame member respectively, wherein said first fastening joint has a first tubular portion connected with said first frame member, and a first affixing portion extended from said first tubular portion and connected to said first reinforcing member, wherein said second fastening joint has a second tubular portion connected with said second frame member, and a second affixing portion extended from said second tubular portion and connected to said second reinforcing member.

19. The sun shading apparatus, as recited in claim 16, wherein said reinforcing frame further comprises a first and a second fastening joint joining said first reinforcing member with said first frame member, and joining said second reinforcing member with said second frame member respectively, wherein said first fastening joint has a first tubular portion connected with said first frame member, and a first affixing portion extended from said first tubular portion and connected to said first reinforcing member, wherein said second fastening joint has a second tubular portion connected with said second frame member, and a second affixing portion extended from said second tubular portion and connected to said second reinforcing member.

20. The sun shading apparatus, as recited in claim 19, further comprising a utility device, wherein said utility device is embodied as a swing and comprises a plurality of utility members pivotally mounted on said supporting bar, and a seating member extended across lower portions of said utility members so that a person is capable of seating on said seating member and grabbing on said utility members to perform swinging motions.

* * * * *